US007377263B2

(12) United States Patent
Muench et al.

(10) Patent No.: US 7,377,263 B2
(45) Date of Patent: May 27, 2008

(54) INTERNAL COMBUSTION ENGINE PROVIDED WITH AN ACCUMULATOR INJECTION SYSTEM

(75) Inventors: Kai-Uwe Muench, St. Augustin (DE); Rolf Preuss, Pulheim (DE); Joerg Schlueter, Wesseling (DE)

(73) Assignee: Deutz Aktiengesellschaft, Cologne (DE)

( * ) Notice: Subject to any disclaimer, the term of this patent is extended or adjusted under 35 U.S.C. 154(b) by 41 days.

(21) Appl. No.: 10/550,570

(22) PCT Filed: Mar. 6, 2004

(86) PCT No.: PCT/EP2004/002312

§ 371 (c)(1),
(2), (4) Date: Sep. 27, 2005

(87) PCT Pub. No.: WO2004/085830

PCT Pub. Date: Oct. 7, 2004

(65) Prior Publication Data

US 2006/0185649 A1 Aug. 24, 2006

(30) Foreign Application Priority Data

Mar. 28, 2003 (DE) ..... 103 14 029

(51) Int. Cl.
*F02M 55/02* (2006.01)
*F02M 55/00* (2006.01)

(52) U.S. Cl. ..... 123/468; 123/456

(58) Field of Classification Search ..... 123/447, 123/468, 456, 469; 285/125.1, 197, 133.11
See application file for complete search history.

(56) References Cited

U.S. PATENT DOCUMENTS

| | | | | |
|---|---|---|---|---|
| 6,145,493 | A * | 11/2000 | Espey | 123/509 |
| 6,237,571 | B1 * | 5/2001 | Harrison | 123/469 |
| 6,330,876 | B1 | 12/2001 | Spinnler et al. | 123/456 |
| 6,644,279 | B1 | 11/2003 | Frank et al. | |
| 6,889,660 | B2 * | 5/2005 | Usui et al. | 123/456 |
| 2004/0118382 | A1 * | 6/2004 | Usui et al. | 123/456 |
| 2004/0200457 | A1 * | 10/2004 | Gottemoller et al. | 123/468 |

FOREIGN PATENT DOCUMENTS

| | | |
|---|---|---|
| DE | 692 00 427 T2 | 2/1995 |
| DE | 197 31 643 | 9/1998 |
| DE | 199 36 534 A1 | 3/2001 |
| DE | 100 45 280 | 1/2002 |
| EP | 0 507 191 | 10/1992 |
| EP | 1 101 931 | 5/2001 |
| EP | 1 249 599 | 10/2002 |
| JP | 2000-291477 | 10/2000 |

OTHER PUBLICATIONS

International Search Report for PCT/EP2004/002312 (3 pages).

* cited by examiner

*Primary Examiner*—Mahmoud Gimie
(74) *Attorney, Agent, or Firm*—Davidson, Davidson & Kappel, LLC

(57) ABSTRACT

An internal combustion engine includes an injection system that is configured as a high-pressure accumulator system in which the number of parts is small and the injection system can be easily assembled. The connecting fittings for the connection of the high-pressure lines are laterally offset with respect to the appertaining injection valves and in that the absolute magnitude of said offset is identical for all injection valves of a row of cylinders of the internal combustion engine.

1 Claim, 1 Drawing Sheet

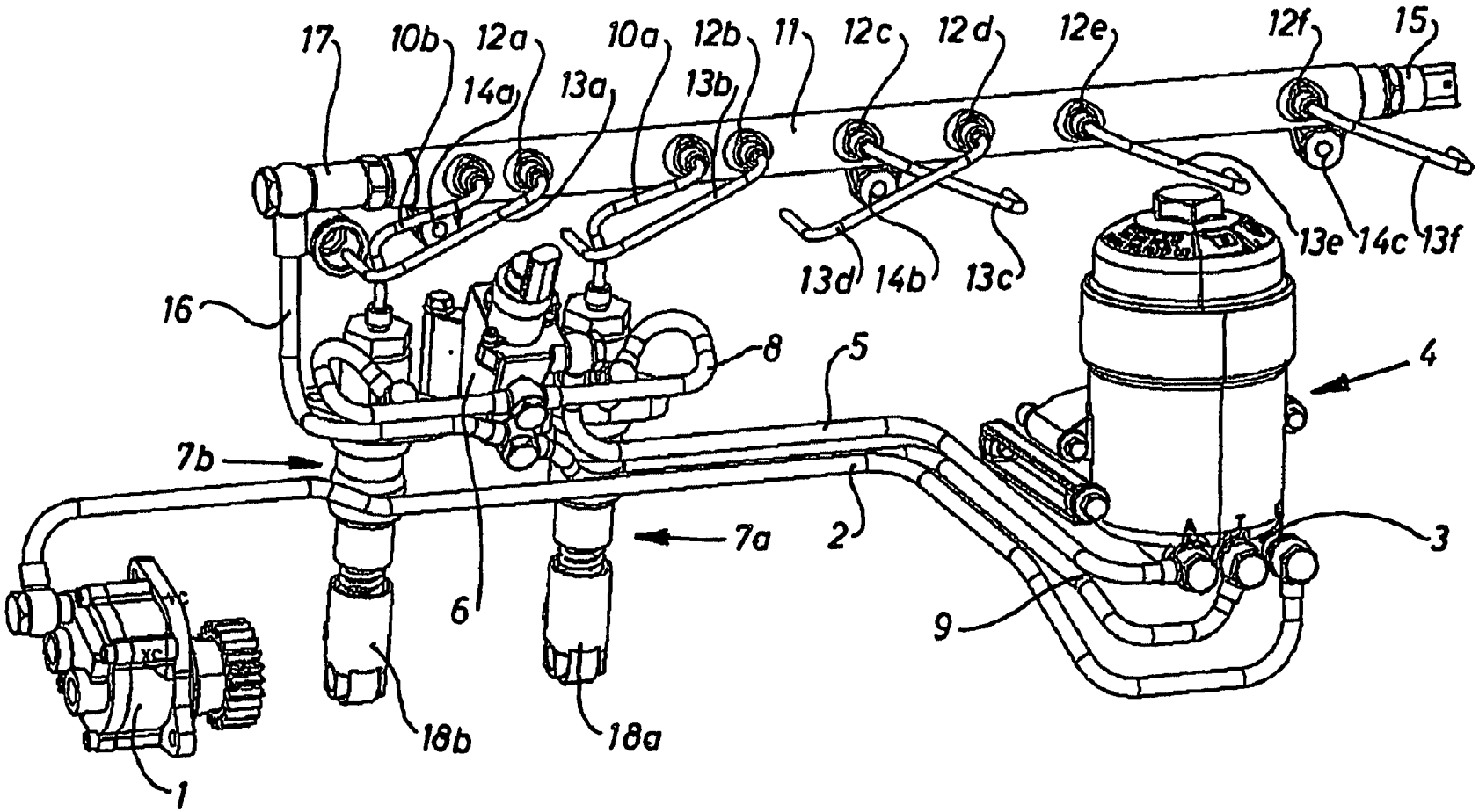
15
12f
13f
14c
13e
4
3
12e
12d
13c
12c
14b
13d
5
2
9
11
12b
13b
8
7a
10a
13a
18a
12a
14a
6
10b
18b
17
16
7b
1

INTERNAL COMBUSTION ENGINE PROVIDED WITH AN ACCUMULATOR INJECTION SYSTEM

The present invention relates to an internal combustion engine with an injection system that is configured as a high-pressure accumulator system, whereby at least one high-pressure pump is connected via a high-pressure supply line to a tubular high-pressure accumulator having connection fittings to which high-pressure lines are connected that establish valve-controlled flow connections to injection valves that are used in the cylinder head of the internal combustion engine and that protrude into working areas formed by the cylinders, the pistons and the cylinder head.

BACKGROUND

Such an internal combustion engine is known from German patent application DE 199 365 34 A1. This internal combustion engine has a tubular high-pressure accumulator that is attached to the internal combustion engine. The special feature of this tubular high-pressure accumulator is that a continuous connection strip is shaped onto the high-pressure accumulator or else there are connection fittings shaped on that are configured with such a width that the bores for connecting the high-pressure lines can be positioned at different places of the connection fittings. As a result, it should be possible to use a high-pressure accumulator part for similar internal combustion engines.

SUMMARY OF THE INVENTION

An object of the present invention is to provide an internal combustion engine having a high-pressure accumulator system with a small number of parts so as to facilitate the assembly of the injection system.

The present invention provides an internal combustion engine with an injection system that is configured as a high-pressure accumulator system, whereby at least one high-pressure pump is connected via a high-pressure supply line to a tubular high-pressure accumulator having connection fittings to which high-pressure lines are connected that serve to establish valve-controlled flow connections to injection valves that are used in the cylinder head of the internal combustion engine and that protrude into working areas formed by the cylinders, the pistons and the cylinder head. The connection fittings are arranged laterally offset with respect to the appertaining injection valves and in that the absolute magnitude of the offset is the same for all of the injection valves of one cylinder row of the internal combustion engine. The lateral offset of the connection fittings relative to the appertaining injection valves—which are each fitted with an electrically operated control block and which are preferably arranged in the middle of the appertaining cylinders in the preferably shared cylinder head of the cylinders of one cylinder row—allows the parts of the injection system to be assembled without any problem since, for instance, the injection valves with their high-pressure connections—which optionally exit laterally from the cylinder head—and the tubular high-pressure accumulator are assembled first and afterwards the corresponding high-pressure lines can subsequently be placed between the injection valves or between the high-pressure line connections and the high-pressure accumulator system without any problem due to the lateral offset of the connections. In this context, it should be taken into consideration that the high-pressure accumulator system is arranged in close proximity to the injection valves in order to keep the length of the high-pressure lines short so as to create a hydraulically stiff injection system. As a result of the fact that the absolute magnitude of the offset is the same for all of the cylinders of one cylinder row and especially matches the distance of the injection valves in the cylinder head, the injection lines can be configured at least all with the same length. This is advantageous for adjusting the injection system.

In an embodiment of the invention, the offset of at least one cylinder at the end is arranged differently from the orientation of the offset of the other cylinders. This configuration ensures that the high-pressure accumulator system has a compact design and, in particular, that it does not extend beyond one cylinder row.

In another embodiment of the invention, there are two differently shaped high-pressure lines for the cylinder row of the internal combustion engine. This is the case when the injection valves are provided with a lateral high-pressure line connection and this connection is pivoted by an angle relative to the transverse axis of the cylinder head. If the high-pressure line connection is oriented precisely crosswise to the longitudinal axis of the cylinder head, all of the high-pressure lines can be shaped the same in an alternative embodiment.

In another embodiment of the invention, the at least one high-pressure pump is arranged close to the cylinder head in a housing, preferably the crankcase of the internal combustion engine, and it is actuated by an injection pump cam that is arranged on the gas-exchange camshaft of the internal combustion engine. This arrangement, in turn, allows a very compact structure of the internal combustion engine and, in particular, does not require any additional drive devices for the high-pressure pump.

In a refinement of the invention, two high-pressure pumps that lie next to each other at a distance are associated with adjacent cylinders. This makes it possible to utilize compact, inexpensive high-pressure pumps. Moreover, the use of two high-pressure pumps brings about an equalization of the pressure build-up in the high-pressure accumulator.

In another embodiment, the high-pressure supply lines that connect the high-pressure pumps to the high-pressure accumulator are configured identically to each other. This minimizes the requirements in terms of parts here as well.

BRIEF DESCRIPTION OF THE DRAWING

In a refinement of the invention, a control block for controlling or regulating the fuel pressure to be established in the high-pressure accumulator is arranged on the inlet side of the at least one high-pressure pump. Here, the control block is arranged next to the one high-pressure pump or between the two high-pressure pumps. As an alternative, the control block can be integrated into the support frame of the fuel filter. This embodiment translates into a very compact injection device.

Additional advantageous embodiments can be gleaned from the description of the drawing in which an embodiment of the invention shown in the FIGURE is described in greater detail.

DETAILED DESCRIPTION

A gear-driven fuel delivery pump 1 conveys fuel from a fuel tank (not shown here) via a feed line 2 into the support frame 3 of a fuel filter 4 in the form of a cup. After the fuel flows through the fuel filter 4, it is introduced into a control block 6 via a flow line 5. The control block 6 contains a pressure-control valve and a zero-delivery throttle that is constantly discharging a small amount of fuel, whereby this amount of fuel discharged by the pressure-control valve and by the zero-delivery throttle is discharged into a return line 9. The pressure-control valve determines the amount of fuel to be fed to two high-pressure pumps 7*a*, 7*b* via a feed line 8. Fuel that is to be discharged is returned to the support frame 3 of the fuel filter 4 via the return line 9. The high-pressure pumps 7*a*, 7*b* are connected to a tubular high-pressure accumulator 11 via identically configured high-pressure supply lines 10*a*, 10*b*. Furthermore, there are connection fittings 12*a*, 12*b*, 12*c*, 12*d*, 12*e*, 12*f* on the high-pressure accumulator 11 to which high-pressure lines 13*a*, 13*b*, 13*c*, 13*d*, 13*e*, 13*f* are fastened which are not connected to injection valves or high-pressure connections. (In the case of the high-pressure line 13*a* located on one end across from the connection on the connection fitting 12*a*, a ring-shaped opening is shown that is formed in the cylinder head and that accommodates a high-pressure connection). The high-pressure accumulator 11 is fastened to the internal combustion engine by means of fasteners 14*a*, 14*b*, 14*c*, particularly to the cylinder head. The high-pressure accumulator 11 has a connection for a pressure sensor 15 and, on the opposite side, a connection for a discharge line 16 that is connected to the return line 9. A pressure-limiting valve 17 is located upstream from the discharge line 16.

The high-pressure pumps 7*a*, 7*b* are installed directly in the crankcase of the internal combustion engine and they have roller tappets 18 that roll on injection pump cams that are arranged on the camshaft of the internal combustion engine between the gas-exchange cams of a cylinder unit. Here, the gas-exchange cams, the injection pump cam and the bearing areas of a cylinder unit following the gas-exchange cams form a continuous unit without interruptions. These high-pressure pumps 7*a*, 7*b* each have a plunger that is actuated by one of the roller tappets 18 and that is designed without a control edge so that it always conveys a prescribed amount of fuel as long as the feed is sufficient. As mentioned above, the fuel pressure in the high-pressure accumulator 11 is controlled or regulated by the pressure-control valve of the control block 6 in that the amount of fuel fed to the high-pressure pumps 7*a*, 7*b* is controlled. In the embodiment shown, the control block 6 is positioned between the high-pressure pumps 7*a*, 7*b*. In an alternative embodiment, this control block 6 can also be integrated into the support frame 3 of the fuel filter 4.

The invention claim is:

1. An internal combustion engine that includes an injection system configured as a high-pressure accumulator system, the internal combustion engine comprising:

at least one high-pressure pump;

a tubular high-pressure accumulator having a plurality of connection fittings;

a high-pressure supply line connecting the at least one high-pressure pump to the tubular high-pressure accumulator; and a plurality of high-pressure connection lines each connected to one of the connection fittings and configured to provide a valve-controlled flow connection to a respective one of a plurality of injection valves of a cylinder row of the internal combustion engine, wherein each of the plurality of connection fittings is disposed laterally offset relative to the corresponding injection valve, and wherein an absolute magnitude of the offset is the same for each of the injection valves;

wherein the plurality of high-pressure connection lines have two different shapes, and each high-pressure connection line has one of the two different shapes.

* * * * *